US006321441B1

(12) United States Patent
Davidson et al.

(10) Patent No.: US 6,321,441 B1
(45) Date of Patent: Nov. 27, 2001

(54) METALLIC KEYS

(75) Inventors: Brian Davidson, Woking; Jeff Mabbot, Sandhurst, both of (GB)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/427,622

(22) Filed: Oct. 27, 1999

(30) Foreign Application Priority Data

Dec. 22, 1998 (GB) ..... 9828369

(51) Int. Cl.[7] ..... H01H 65/00

(52) U.S. Cl. ..... 29/622; 200/512; 200/5 A; 200/159 B

(58) Field of Search ..... 29/622, 825, 827, 29/829, 831; 200/512, 268, 269, 292

(56) References Cited

U.S. PATENT DOCUMENTS

| | | | | |
|---|---|---|---|---|
| 4,317,011 | * | 2/1982 | Mazurk | 200/5 |
| 4,326,930 | * | 4/1982 | Nagel | 204/20 |
| 4,400,595 | * | 8/1983 | Ahumada | 200/5 |
| 4,461,934 | * | 7/1984 | Jabben | 200/5 |
| 4,499,662 | | 2/1985 | Takeuchi | 29/622 |
| 4,532,575 | * | 7/1985 | Suwa | 361/413 |
| 4,620,075 | * | 10/1986 | La Belle et al. | 200/159 |
| 4,633,050 | * | 12/1986 | Samuels | 200/268 |
| 4,714,804 | * | 12/1987 | Yasuda | 200/11 |
| 4,771,143 | * | 9/1988 | Hoffmann | 200/159 |
| 4,801,768 | * | 1/1989 | Sugiyama | 200/5 |
| 4,847,452 | * | 7/1989 | Inaba | 200/5 |
| 4,870,751 | | 10/1989 | Antoon . | |
| 4,876,145 | | 10/1989 | Maeda et al. . | |
| 5,193,668 | * | 3/1993 | Fukuchi et al. | 200/512 |
| 5,397,867 | * | 3/1995 | Demeo | 200/4 |
| 5,467,068 | * | 11/1995 | Feild | 335/4 |
| 5,561,278 | * | 10/1996 | Rutten | 200/5 |
| 5,655,826 | | 8/1997 | Kouno et al. | 362/24 |
| 5,734,137 | * | 3/1998 | Wakefeild | 200/5 |

FOREIGN PATENT DOCUMENTS

| | | | |
|---|---|---|---|
| 2093993 | 2/1972 | (FR) . | |
| 2389217 | 11/1978 | (FR) . | |
| 2311748 | 10/1997 | (GB) | H01H/9/16 |
| WO9738842 | 10/1997 | (WO) . | |

* cited by examiner

*Primary Examiner*—David P. Bryant
*Assistant Examiner*—Sean Smith
(74) *Attorney, Agent, or Firm*—Antonelli, Terry, Stout & Kraus, LLP

(57) ABSTRACT

A method of forming a key comprising the steps of: depositing an electroless metallic layer on an upper surface of a substrate; removing the metallic layer from selected portions to expose the substrate, said exposed portions of the substrate defining the image of an indicia; depositing a second metallic layer on the remaining portions of the first metallic layer by electrolysis; and coupling a lower surface of the substrate to an element for actuating a switch. A device for tactile actuation by a user, having an element, for activating a switch, coupled to a body supporting a metallic layer for tactile actuation by a user, wherein the metallic layer extends over an upper surface of the body and wherein at least one aperture extends through the metallic layer to said upper surface thereby defining at least one visible indicia.

7 Claims, 5 Drawing Sheets

METALLIC KEYS

BACKGROUND OF THE INVENTION

The present invention relates to a device for tactile actuation or keying by a user and the method of forming such a device. It particularly relates to a device having a metal finish with images particularly indicia defined therein. The device may be a key in a keyboard.

It is often desirable to give devices a metallic or metallic looking finish. Such a finish generally has high lustre and is aesthetically pleasing to the user.

In the portable radio telephone market phones with a metallic finish and with keys with a metallic finish are known.

One problem with keys having a metallic finish is that it is difficult to indelibly put images of indicia onto the keys such as letters, numbers or characters which indicate the key's function.

Another problem is that it is difficult to define fine characters on metal keys. Consequently it is difficult to put more complex characters, in particular Chinese and/or Japanese Characters, or more than one character on small keys.

Another problem is arranging for the indicia defined onto the metal keys to be visible to a user in a range of ambient lighting environments.

It would be desirable to provide improved keys with a metallic finish.

SUMMARY OF THE INVENTION

According to one aspect of the present invention there is provided a device for tactile actuation by a user, having an element, for activating a switch, coupled to a body supporting a metallic layer for tactile actuation by a user, wherein the metallic layer extends over an upper surface of the body and wherein at least one aperture extends through the metallic layer to said upper surface thereby defining at least one visible indicia.

The indicia defined by the aperture or apertures can be particularly fine. Furthermore, the keys can be effectively back-lit, have aesthetic appeal, are hard-wearing, and can be formed from a simple manufacturing process.

According to another aspect of the present invention there is provided a method of forming a key for tactile activation by a user comprising the steps of: depositing a first metallic layer on an upper surface of a substrate; removing the metallic layer from selected portions to expose the substrate, said exposed portions of the substrate defining the image of an indicia; depositing a second metallic layer on the remaining portions of the first metallic layer; and coupling a lower surface of the substrate to an element for actuating a switch such that, in use, tactile actuation of the key through the second metallic layer activates the switch.

BRIEF DESCRIPTION OF THE DRAWINGS

For a better understanding of the present invention and to understand how the same may be brought into effect reference will now be made by way of example only to the following drawings in which.

DETAILED DESCRIPTION

Figure 1:
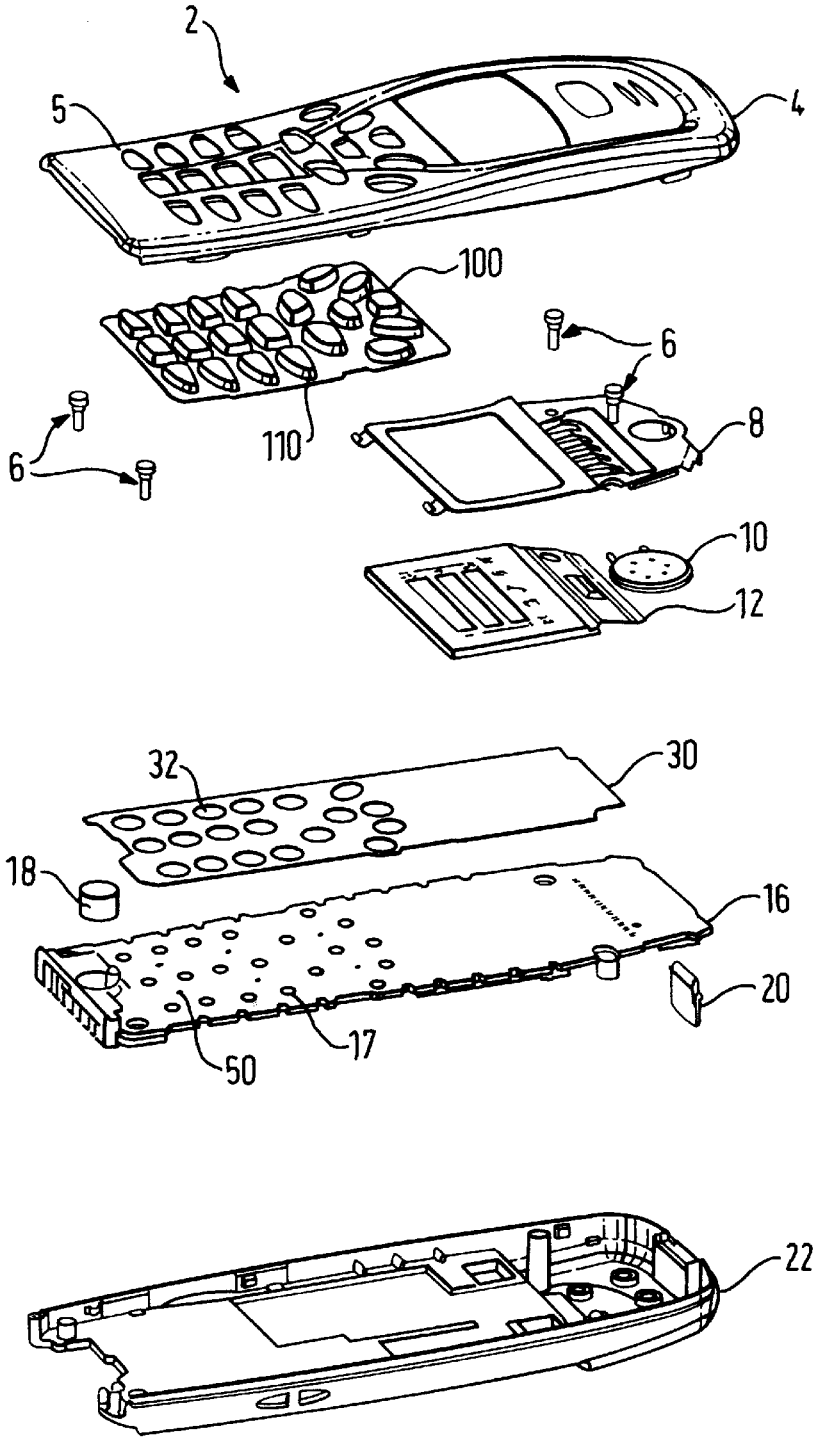
FIG. 1 illustrates a mobile phone in an exploded view.

Referring to FIG. 1, a mobile phone 2 is shown in an exploded view and some of the various components which make up a portable radiotelephone can be identified. These include a front cover (also known as the A-cover) 4, keypad 100, retaining screws 6, display clamp 8 for retaining the display 12, speaker 10, a layer 30 of key dome switch elements 32, microphone 18, printed circuit board (PCB) 16, retaining clip 20 for fastening the front cover 4, and a rear cover (also known as B-cover) 22. The battery (not shown) clips onto the rear of the telephone forming an integral part of the rear cover 22.

The keypad 100 has keys 110 arranged in an array. The front cover 4 has a corresponding array of apertures 5. When the phone is assembled, each key 110 of the keypad 110 protrudes through a corresponding aperture 5 in the front cover 4 and overlies a corresponding key dome switch element 32 of the layer 30. When a user depresses one of the keys 110 the corresponding switching element 32 completes a circuit on the PCB 16 and controls the phones functionality. Each of the keys 110 carries on the upper surface protruding from the front cover 4 indicia, such as numeral (s), character(s) and/or letter(s), indicating the function of the key.

Figure 2:
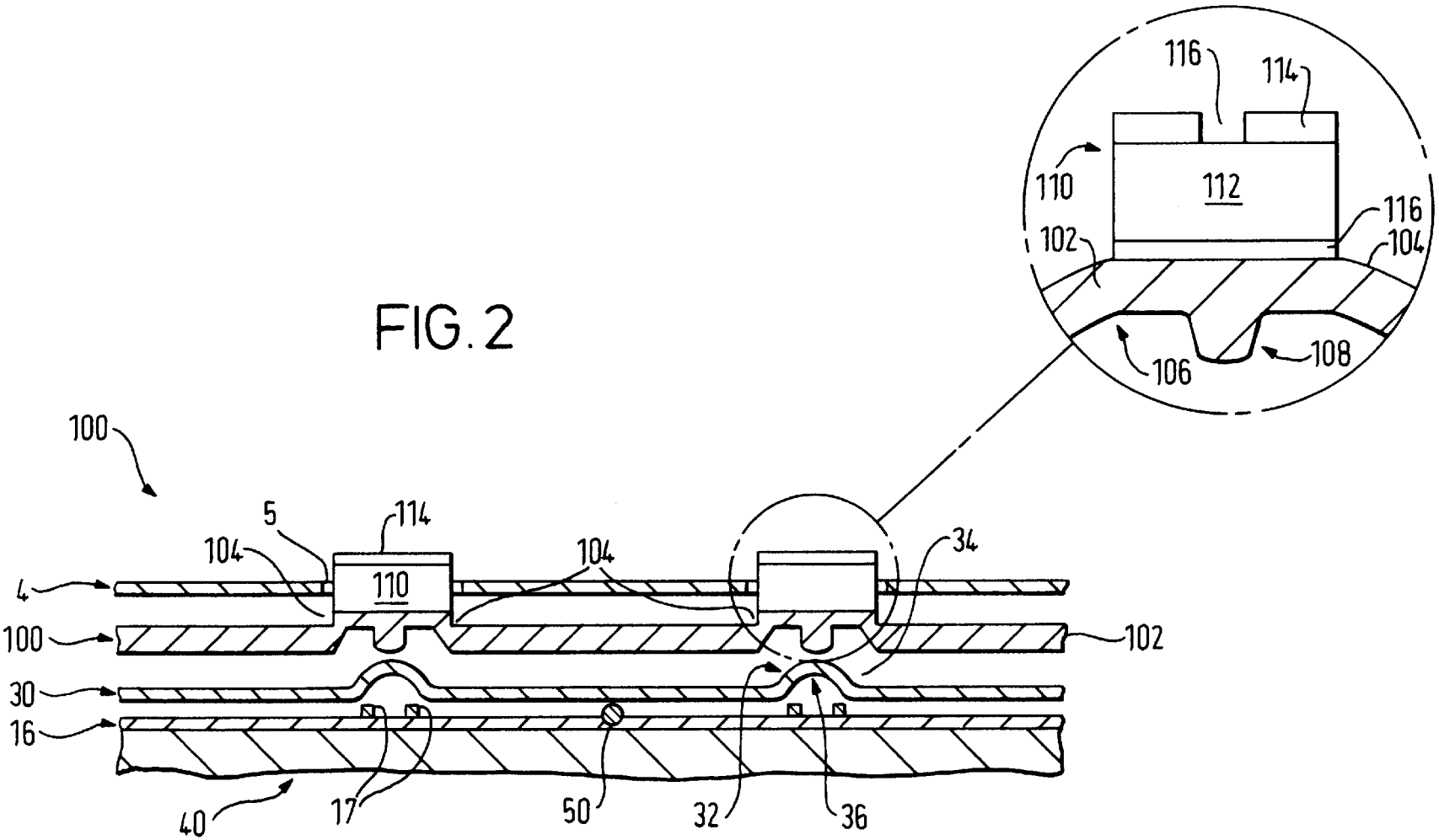
FIG. 2 illustrates a cross-section of the keypad and switching assemblies.

One design of keypad 100 is shown in cross-section in FIG. 2. The keypad comprises a flexible rubber keymat 102 to which keys 110 are attached by adhesive 116. Each key 110 has a body or substrate 112 which projects through a corresponding hole 5 in the front cover 4 and which has, extending over its upper surface, a metal layer 114. The metal layer 114 has a metal finish which has a high luster and is hard wearing. Indicia are defined on the upper surface of the keys 110 by apertures 116 in the metal layer which expose the underlying body 112.

The portions of the keymat 102 to which the keys are attached on an upper surface 104 are surrounded and joined to the main web of the keymat by resilient deformation zones 104, and have on a lower surface 106, directly underlying each of the attached keys 110, a projection 108.

A switch assembly 40 underlies but is separated from each projection 108. Each switch assembly 40 comprises a key dome switch element 32 overlying two lower switch elements 17. Each key dome switch element 32 is formed from a flexible dome 34 of resilient material protruding upwards from a layer 30 of sheet material. The underside of each flexible dome 30 has a conductive portion 36. The lower switch elements 17 are connected to the PCB 16.

When a user presses the metal layer 114 of the key 110, the resilience of the deformation zone surrounding the key allows the key to travel towards the switch assembly 40 associated with the key so that the projection 108 can activate the switch assembly. The projection 108 urges the dome 34 to deform suddenly to a configuration in which the conductive portion 36 on its underside bridges the lower switch elements 17 and connects them together electrically. When the key portion is released the deformation zone 104 urges it to return to its original position as illustrated in FIG. 2, thereby disconnecting the switch elements 17 from each other.

The PCB 16 has on its upper surface an array of light sources such as light emitting diodes (LEDs) 50. The domes 34 are made from a translucent resiliently flexible material. Preferably, the layer 30 and the domes 34 are formed from a silicone rubber mat. The keymat 102 is made from a translucent resiliently flexible material such as silicone rubber. The layer of adhesive 116 joining the body 116 of the key 110 to the keymat 102 is also translucent. The body 112 of the key is translucent. It is preferably made from a translucent plastics material. The layer 114, which has a metal finish, is opaque. The light from the light source 50 can therefore travel through the intervening structures into the body 112 of the key. In a poorly lit environment, the light source is activated and the aperture 116 on the upper surface of the key 110 defining indicia is illuminated and can be clearly discerned in contrast to the opaque metal layer 114. In a well-lit environment, the layer 114 reflects the ambient light, whereas the light falling on the aperture 116 passes into the body 112. Consequently, the indicia defined by the aperture can be clearly discerned in contrast to the reflecting metallic layer 114. Preferably, the aperture has a breadth which is great enough for the indicia to be resolved by the naked eye but narrow enough to accurately define complex indicia. Typically the breadth is between 0.15 and 0.45 mm.

Figure 3A:
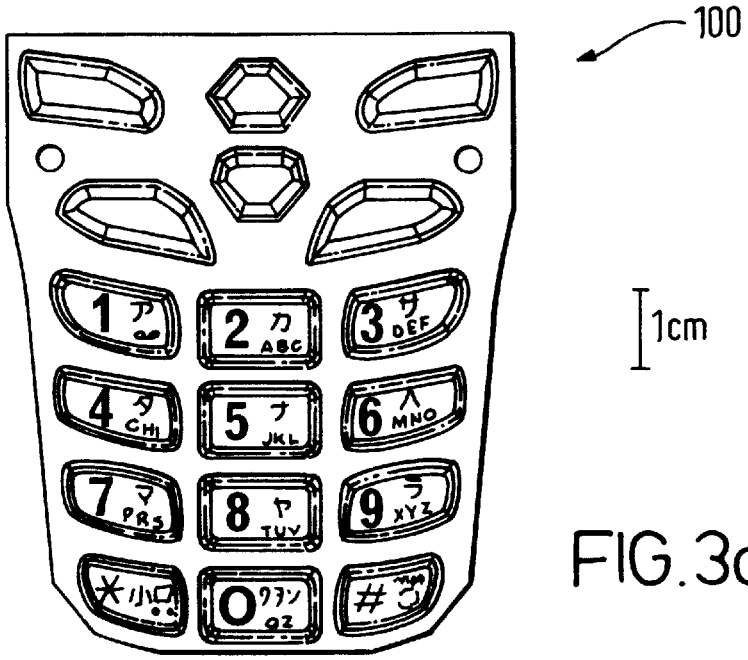
FIGS. 3*a* and 3*b* illustrates an assembled keymat.
Figure 3B:
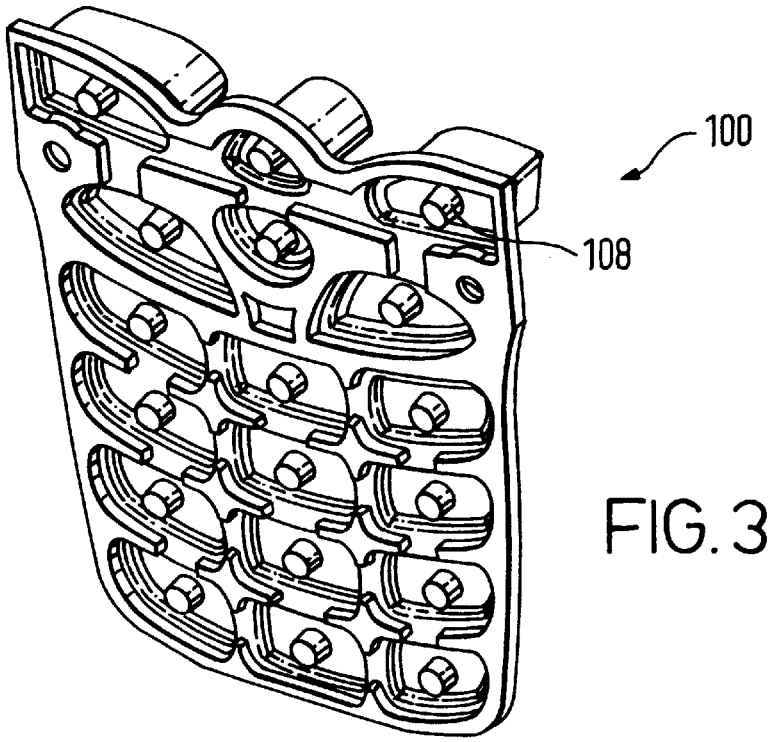

The keypad 100 is illustrated in FIGS. 3*a* and 3*b*. FIG. 3*a* shows a front view of a keypad 100 intended for the Japanese market. It is shown to scale. FIG. 3*b* is a perspective rear view of the keypad 100.

Figure 4A:
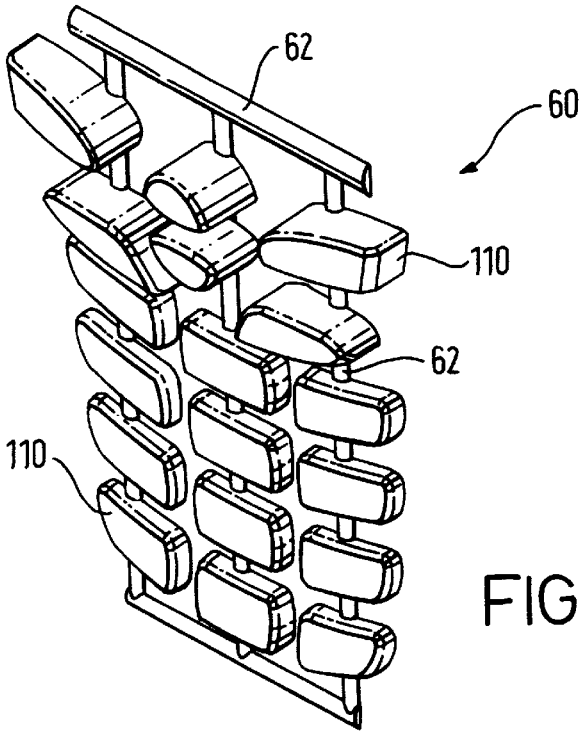
FIGS. 4*a* and 4*b* illustrate the assembly of a keymat.
Figure 4B:
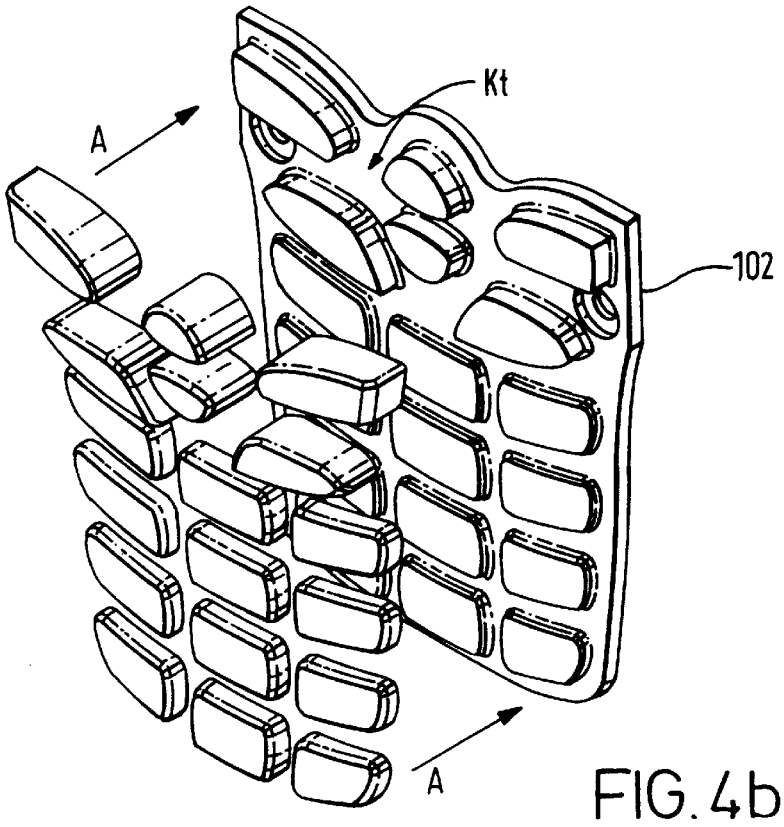

The process of making a keypad is illustrated in FIGS. 4*a* and 4*b*. Referring to FIG. 4*a* there is illustrated a frame 60 of keys 110. The keys 110 are fully formed and include the body 112 and metal layer 114 as a finish. The keys 110 are held as an array by interconnects 62. The array corresponds to the array of projections 108 on the underside of the keymat 102, the array of apertures 5 in the front cover 4, the array of domes 34 on the layer 30 and the array of switch elements 17 on the PCB 16. The keys 110 are adhered to the keymat 102 to form the keypad 100 as shown in FIG. 4*b*. For the sake of clarity, the interconnects 62 are not shown.

A process for forming the metal layer 114 on the keys 110 will now be described. Although this process would occur to each key forming part of a frame 60, for the sake of clarity it will be describe with relation to one key only.

The inventors have made the surprising innovation that a process known from the art of conductive interconnects which is used to form thin tracks of interconnect on circuit boards can be used in a new method to form the extensive metal layer 114 while simultaneously creating narrow apertures which define fine indicia. The process has previously been used to form Moulded Interconnect Devices (MID) and further information on the process is published by "Moulded Interconnect Device International Association".

One process of forming the layer 114 is illustrated in FIGS. 5*a* to 5*h*. The use of photoresists and etchants is well document in the art of Very Large Scale Integration (VLSI).

Figure 5A:
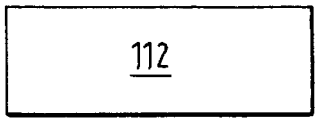
FIGS. 5*a* to 5*h* illustrate the creation of a key 110 with a metal finish.
Figure 5B:
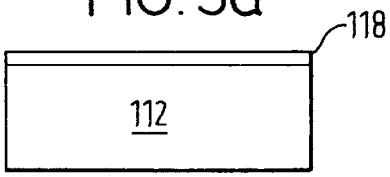

FIG. 5*a* illustrates the body 112 of a key 110 which acts as a substrate for the metal layer 114. The body 112 is made of plastics material, preferably translucent plastics. It has been found that polytherimide (PEI) or acrylic-butadiene-styrene (ABS) are suitable.

A first metallic layer 118 of electroless copper is formed on the upper surface of the body 112. The body 112 has a catalyst such as palladium added to its upper surface and is placed into a bath of chemicals containing copper salt and a reducing agent such as formaldehyde. The copper salt is reduced in the presence of the catalyst to metallic copper and is thereby deposited on the surface of the body 112. The layer 118 of electroless copper typically has a thickness of 1–1.5 microns.

Figure 5C:
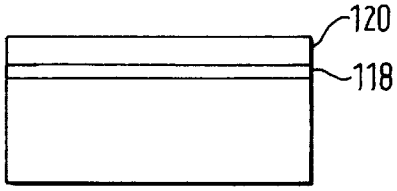
Figure 5D:
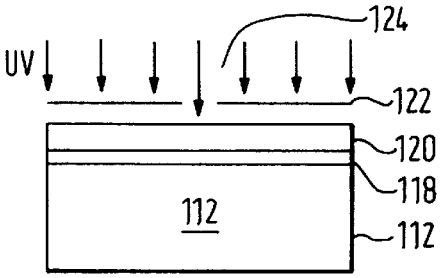

A photoresist layer 120 is then applied to the upper surface of the first metallic layer 118 as illustrated in FIG. 5*c*.

Figure 5E:
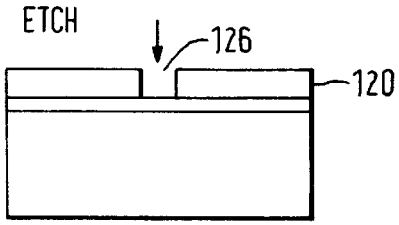

An opaque mask 122 is then placed over the photoresist layer 120. The mask 122 has apertures 124 defined in it. These apertures 124 have the shape of the indicia which will be defined by the apertures 116 in the metal layer 114. The mask is then illuminated with UV light. The photoresist 120 exposed through the aperture 124 becomes soluble and is removed to form an aperture 126 in the photoresist layer 120. The remaining photoresist acts as a mask while the first metallic layer 118 is etched through the aperture 126 as illustrated in FIG. 5*e*.

Figure 5F:
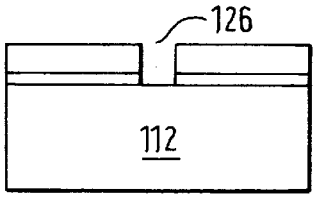
Figure 5G:
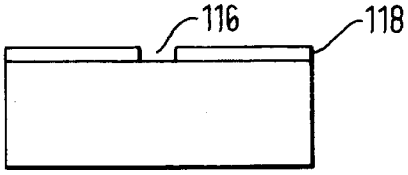
Figure 5H:
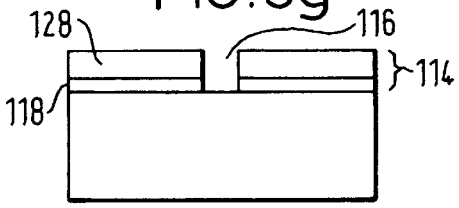

The structure formed at the end of the etch step is illustrated in FIG. 5*f*. The first metallic layer 118 has been completely removed in the aperture 126 to expose the upper surface of the body 112. The remaining photoresist layer 120 is then removed exposing the first metallic layer 118 with an aperture 116 therein exposing the upper surface of the body 112.

A second layer 128 containing metal is then deposited on the first metal layer 118 using electrolytic plating techniques. The first and second metallic layers in combination form the layer 114 previously described. An aperture 116 extends through both layers to exposed the upper surface of the body 112.

A layer formed by electroless deposition may contain impurities from the chemical bath in which the copper deposited was reduced. In particular the reducing agent such as formaldehyde may be present.

Although in the forgoing description a particular method of forming the metal layer on the keys has been described and a particular application described it should be appreciated that the scope of the invention is not so limited.

What is claimed is:

1. A method of forming a key for tactile activation by a user comprising the steps of:

a) depositing a first metallic layer on an upper surface of a substrate;

b) removing the metallic layer from selected portions to expose the substrate, said exposed portions of the substrate defining the image of an indicia;

c) depositing a second metallic layer on the remaining portions of the first metallic layer; and d) coupling a lower surface of the substrate to an element for actuating a switch such that, in use, tactile actuation of the key through the second metallic layer activates the switch.

2. A method according to claim 1 wherein the first metallic layer is formed by electroless plating.

3. A method according to claim 2 wherein the first metallic layer is formed by reducing copper salts.

4. A method as claimed in claim 1 wherein step b) comprises the masked etch back of the first metallic layer.

5. A method as claimed in claim 4 comprising the steps of:

forming a mask layer having an aperture or apertures exposing portions of the first metallic layer overlying said selected portions of the substrate and etching the first metallic layer through said aperture or apertures to expose said substrate.

6. A method as claimed in claim 5 wherein the step of forming a mask layer comprises depositing a photoresist layer, selectively exposing portions of the photoresist layer, removing either the exposed or unexposed portions of the photoresist layer to define a mask layer comprising photoresist extending over the first metallic layer and having apertures therein exposing the portions of said first metallic layer overlying said selected portions of the substrate.

7. A method as claimed in claim 1 wherein the step of depositing a second metallic layer involves depositing the second metallic layer by electrolysis.

* * * * *